US007802746B2

(12) United States Patent
Ito et al.

(10) Patent No.: US 7,802,746 B2
(45) Date of Patent: Sep. 28, 2010

(54) HANGING DEVICE

(75) Inventors: Tomohiro Ito, Tokyo (JP); Jun Ishikawa, Tokyo (JP)

(73) Assignee: Sony Corporation, Tokyo (JP)

( * ) Notice: Subject to any disclaimer, the term of this patent is extended or adjusted under 35 U.S.C. 154(b) by 70 days.

(21) Appl. No.: 12/122,182

(22) Filed: May 16, 2008

(65) Prior Publication Data

US 2008/0283651 A1 Nov. 20, 2008

(30) Foreign Application Priority Data

May 18, 2007 (JP) ..... 2007-132877

(51) Int. Cl.
*B65H 75/48* (2006.01)

(52) U.S. Cl. ..... 242/379; 242/380; 242/379.2; 242/378.1; 439/349

(58) Field of Classification Search ..... 381/383, 381/379, 378, 377, 374, 370; 242/379, 385, 242/385.1, 380, 388, 388.1, 379.2, 378.1, 242/370, 371, 389, 398; 24/629, 633, 639, 24/640, 642, 3.11, 3.12, 3.13; 439/349, 352; 285/307, 314, 315, 319, 320
See application file for complete search history.

(56) References Cited

U.S. PATENT DOCUMENTS 3,314,696 A * 4/1967 Ferguson et al. ..... 285/148.14
4,802,638 A * 2/1989 Burger et al. ..... 242/388.1
5,642,402 A * 6/1997 Vilmi et al. ..... 455/569.2
5,954,288 A * 9/1999 Shih ..... 242/380
6,075,999 A * 6/2000 Vilmi et al. ..... 455/569.2
6,199,674 B1 * 3/2001 Liao ..... 191/12.4
6,851,530 B2 * 2/2005 Wei ..... 191/12.2 R
6,966,519 B2 * 11/2005 Salentine et al. ..... 242/379
7,478,776 B2 * 1/2009 Salentine et al. ..... 242/379
2003/0042348 A1 * 3/2003 Salentine et al. ..... 242/380
2003/0142817 A1 * 7/2003 Liao ..... 379/428.01
2007/0177742 A1 * 8/2007 Edgren et al. ..... 381/89
2008/0089544 A1 * 4/2008 Ito ..... 381/370

FOREIGN PATENT DOCUMENTS

JP 57-091389 6/1982
JP 5-34840 5/1993
JP 2008098925 A * 4/2008
JP 2008288960 A * 11/2008
JP 2008288961 A * 11/2008
JP 2008303037 A * 12/2008

* cited by examiner

*Primary Examiner*—John Q Nguyen
*Assistant Examiner*—Juan J Campos
(74) *Attorney, Agent, or Firm*—Oblon, Spivak, McClelland, Maier & Neustadt, L.L.P.

(57) ABSTRACT

Disclosed herein is a hanging device including: a reeling portion which includes a reel adapted to reel a cord connected to an electronic device or component part and in which the reel is turned to pull out the cord from an orifice portion of a casing and to reel the cord through the orifice portion; an engaging portion disposed in the vicinity of the orifice portion of the reeling portion; and a connecting member attached to the cord so as to be engageable with and disengageable from an engaging portion of the orifice portion.

16 Claims, 10 Drawing Sheets

HANGING DEVICE

CROSS REFERENCES TO RELATED APPLICATIONS

The present invention contains subject matter related to Japanese Patent Application JP 2007-132877 filed in the Japan Patent Office on May 18, 2007, the entire contents of which being incorporated herein by reference.

BACKGROUND OF THE INVENTION

1. Field of the Invention

The present invention relates to a hanging device to hang electric equipment to which a cord is connected and to a reeling device used for the hanging device.

2. Description of the Related Art

As the technology of mobile-phones advances, the mobile-phones incorporate various functions. Specifically, the mobile-phones tend to incorporate various additional functions such as a function as a television broadcasting receiver called a one-segment television, a settlement function such as Suica (trade mark) or Felica (trade mark), etc., as well as functions such as digital cameras and music players. In this tendency, the user hangs a music player from her or his neck through a neck stripe or puts it in a breast pocket or in a bag for use. Further, in place of the behavior pattern along with a wallet or with a pass card, while hanging the mobile-phone from a user's neck through a neck strap, the user can watch television broadcasting, move by train or buy something.

Electronic devices attached with a cord to transmit power supply or an audio signal is each provided with a reeling device to reel the cord. Such provision of the reeling device is widely done as disclosed in Japanese Patent Publication No. Hei 5-34840 and Japanese Utility Model Laid-Open No. Sho 57-91389. It is not uncommon that a headphone or headset uses a reeling device for reeling a cord to prevent entanglement of the cord during storage. Under such situations, the multifunction of mobile-phones or the advancement of portable electronic devices such as portable digital players that reproduce several hundreds or thousands of tunes tends to need usage taking into account more convenient portability.

There is not a strap type headphone or headset convenient for a multifunctional mobile-phone because of the following. The strap type headphone in the past is of a type in which a compact player is hung from the user's neck through a neck strap. If a mobile-phone having a function of a one-segment television receiver and/or a settlement function is hung from the user's neck for use, the hanging length from the neck strap to the mobile-phone is a constant value from the user's neck to breast. In such a state, if the user intends to watch television broadcasting on the mobile-phone using the one-segment function, the distance from the user's breast to the mobile-phone is about 20 cm, which means the position of the display of the mobile-phone is too close to the user. It is necessary, therefore, to remove the neck strap when the user watches television broadcasting on the mobile-phone. The automatic ticket gate has a touch sensor at a position approximately equal in height to the user's waist. The user has to assume an unnatural posture to hold the mobile-phone hung from the user's neck through the neck strap over the touch sensor of the ticket gate. Therefore, it is necessary for the user all of the time to remove the mobile-phone from the neck and cause it to access the touch sensor of the ticket gate.

The cord reeled by the reeling device has a full length determined by assuming the maximum pulled-out length. However, in fact the length of the cord to be used varies depending on the mode of use, user's preference or the like. If the length of the cord is set at the maximum, therefore, the cord causes an excess portion to a varying degree. If such an excess portion is not reeled by any reeling section, there arises a problem in that the cord is caught by other portions or the handling of the excess portion becomes troublesome.

SUMMARY OF THE INVENTION

It is desirable to provide a hanging device for a portable electronic device in which it is hung by a neck strap worn around a user's neck, a cord can be reeled by a reeling device and a use position can optionally be adjusted.

It is further desirable to provide a hanging device that causes the load of an electronic device not to be applied to a cord.

It is further desirable to provide a hanging device that can prevent even a heavy electronic device from being pulled out from a reeling device and moving downward under its own weight.

It is further desirable to provide a hanging device that can optionally adjust the length of a cord and thereby enables watching of television broadcasting with an electronic device being hung from a user's neck.

It is further desirable to provide a hanging device that can cause a handheld terminal to access a touch sensor of an automatic ticket gate with the handheld terminal being hung from a user's neck.

According to an embodiment of the present invention, there is provided a hanging device including: a reeling portion which includes a reel adapted to reel a cord connected to an electronic device or component part and in which the reel is turned to pull out the cord from an orifice portion of a casing and to reel the cord through the orifice portion; an engaging portion disposed in the vicinity of the orifice portion of the reeling portion; and a connecting member attached to the cord so as to be engageable with and disengageable from an engaging portion of the orifice portion.

According to another preferable embodiment of the present invention, there is provided a neck strap type headphone/headset hanging device. This hanging device is configured to reel a plug-attached cord around a flat spiral spring-attached reel and to include a connecting member connected to a mobile-phone and provided with an engaging mechanism adapted to prevent the cord from being pulled out. The pulled-out length of the cord can be adjusted within a range from 0 to 0.6 m. Means for fixing the pulled-out length of the cord can be released by further pulling out the cord. The length of a hanging strap used to hang the mobile-phone from the connecting member can be adjusted. A microphone and an incoming alert switch are provided in the plug provided at the tip of the cord. An excess portion of the cord can be stored in the connecting member or is composed of a curl cord. Alternatively, reeling means is provided to reel the excess portion of the cord.

With such an embodiment configured as above, the strap-wearing type headphone/headset which reels the cord around the flat coil spring-attached reel is such that the connecting member is provided with the engaging mechanism. Thus, it is possible to prevent even a heavy mobile-phone from moving downward under its own weight, to lightly pull out the cord and to set the reeling force at a not-excessive level. Since the mobile-phone is connected to the reelable cord, the length of the cord can be adjusted so that the user can watch television broadcasting on the mobile-phone using a one-segment function with the mobile-phone hung from the user's neck via the neck strap. When the user passes through an automatic ticket gate, the user can easily cause the mobile-phone hung from the user's neck via the neck strap to access a touch sensor, which eliminates removal of the neck strap from the neck each time. For configuration of a headset, a microphone is disposed inside the plug so that a shield wire for the microphone can be terminated inside the microphone. A reeling cord portion needs only to deal with only an audio signal, which can make a wire configuration simple and also the cord thin. In addition, it is possible to enable the downsizing and weight reduction of the reeling portion and an improvement in durability due to the prevention of cord disconnection. The excess portion of the connection plug-attached cord is reeled around a reeling device or is configured as a curl cord, which eliminates the external protrusion of the excess portion of the cord.

According to the embodiment of the present invention, there is provided a hanging device including: a reeling portion which includes a reel adapted to reel a cord connected to an electronic device or component part and in which the reel is turned to pull out the cord from an orifice portion of a casing and to reel the cord through the orifice portion; an engaging portion disposed in the vicinity of the orifice portion of the reeling portion; and a connecting member attached to the cord so as to be engageable with and disengageable from an engaging portion of the orifice portion.

With the hanging device configured as above, when the connecting member is disengaged from the connecting member and a portable electronic device is manually moved to an optional position, the cord connected to the electronic device can be pulled out from the reeling device. Thus, the electronic device can be used at an optional position.

DETAILED DESCRIPTION OF THE PREFERRED EMBODIMENTS

Figure 1:
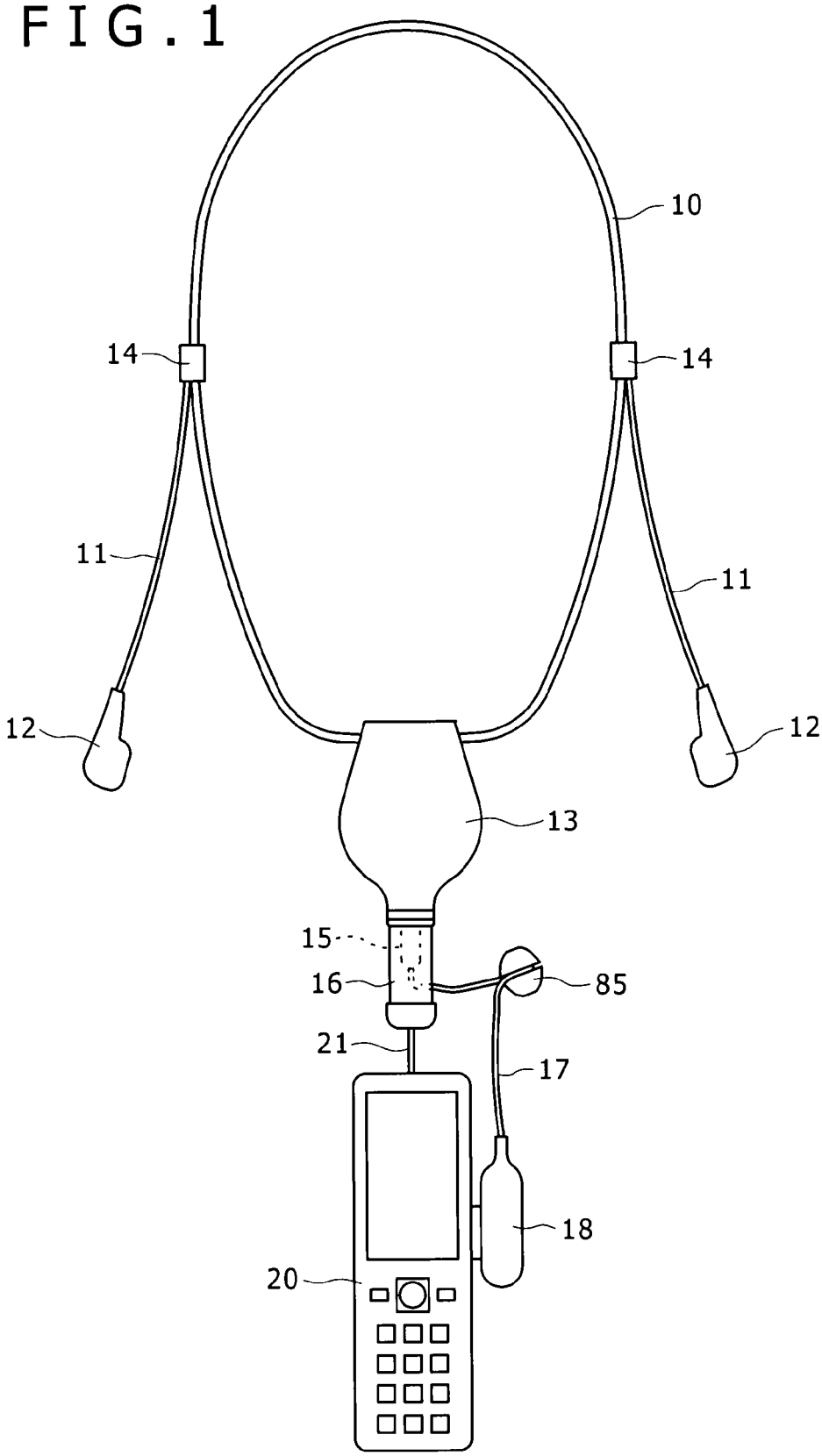
FIG. 1 is a front view illustrating the entire configuration of a hanging device for a mobile-phone.

Embodiments of the present invention will hereinafter be described with reference to the accompanying drawings. FIG. 1 illustrates the entire configuration of a mobile-phone hanging device according to an embodiment of the invention. This hanging device is provided with a neck strap 10, which is worn around a user's neck to hang and hold a mobile-phone 20. Cords 11 are connected to the neck strap 10 so as to extend along the lengthwise direction thereof and can be separated from the neck strap 10 at the respective positions of checks 14. An earphone unit 12 or a headphone unit is connected to each of the respective leading ends of the cords 11.

A reeling device 13 is attached to the neck strap 10 at a position corresponding to a pendant. A connecting member 16 is connected to a tubular orifice portion 15 located on the lower end of the reeling device 13. A cord 17 is pulled out from a side of the connecting member 16 and connected with a plug 18 at the tip thereof. The plug 18 can be inserted into a laterally located jack of the mobile-phone 20. In this way, the mobile-phone 20 is hung by the connecting member 16 via a hanging strap 21.

This system of hanging the mobile-phone 20 is defined by causing the neck strap 10 to hang the load of the mobile-phone 20 via the reeling device 13, connecting member 16 and hanging strap 21. It is to be noted that the load of the mobile-phone 20 is not applied to the cord 17 that can be reeled or unreeled by the reeling device 13. This is because of the adoption of a configuration in which the connecting member 16 is provided with an engaging mechanism which causes the connecting member 16 to be engaged with and held by the tubular orifice portion 15 of the casing of the reeling device 13.

Figure 2:
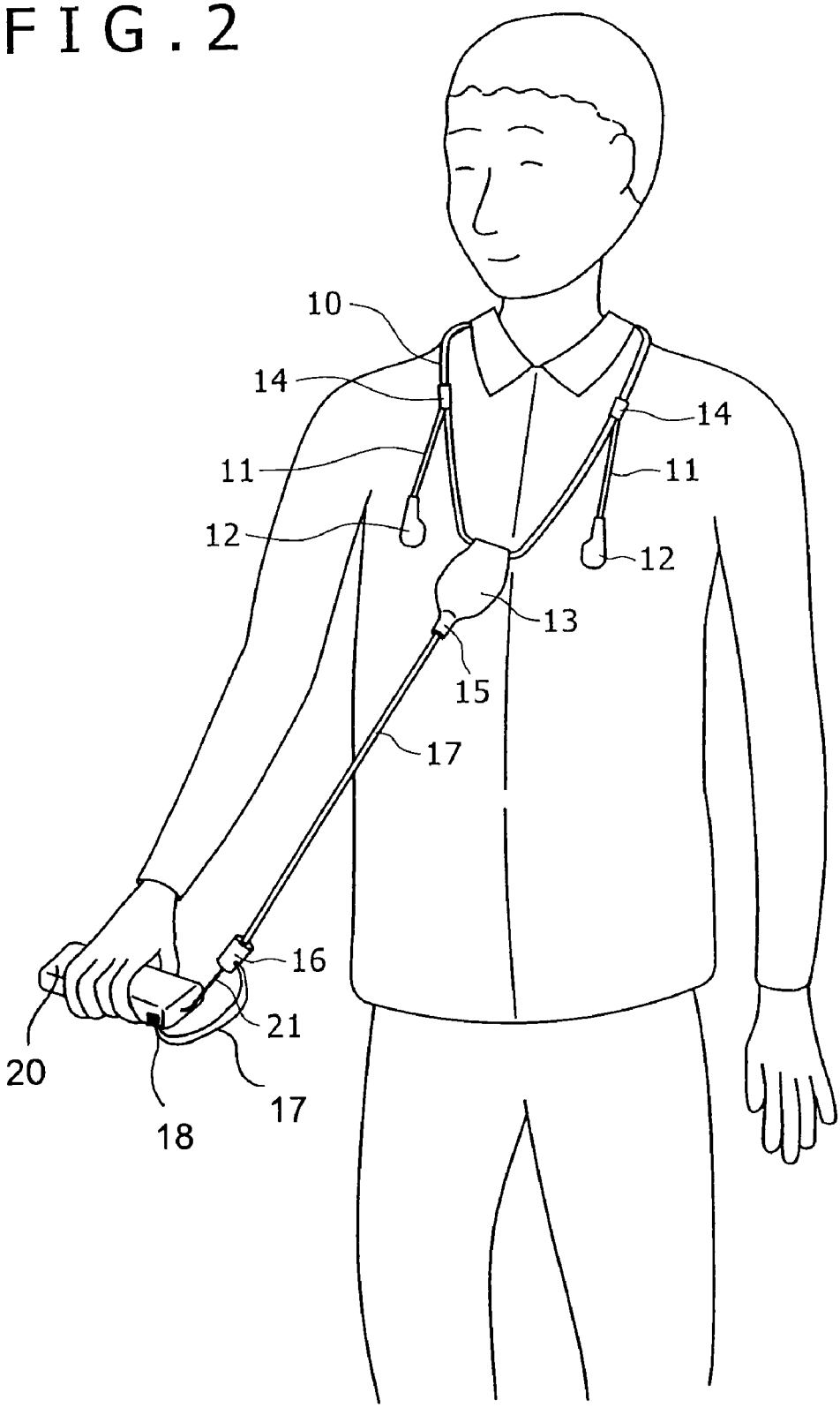
FIG. 2 illustrates performance of pulling out a cord connected to the mobile-phone.

If the engagement of the tubular orifice portion 15 of the reeling device 13 with the connecting member 16 is released, the connecting member 16 is disengaged from the tubular orifice portion 15 as shown in FIG. 2. When the mobile-phone 20 is held with a user's hand and moved away from the reeling device 13, the cord 17 connected to the mobile-phone 20 via the plug 18 is pulled out from the tubular orifice portion 15 of the reeling device 13. Thus, the user can move the mobile-phone 20 to an optional position by pulling out the cord 17 reeled by the reeling device 13 up to the maximum length. For example, when the mobile-phone 20 is caused to access the touch sensor of an automatic ticket gate, it is easy to hold the mobile-phone 20 over the touch sensor of the ticket gate by disengaging the connecting member 16 from the tubular orifice portion 15.

Figure 3:
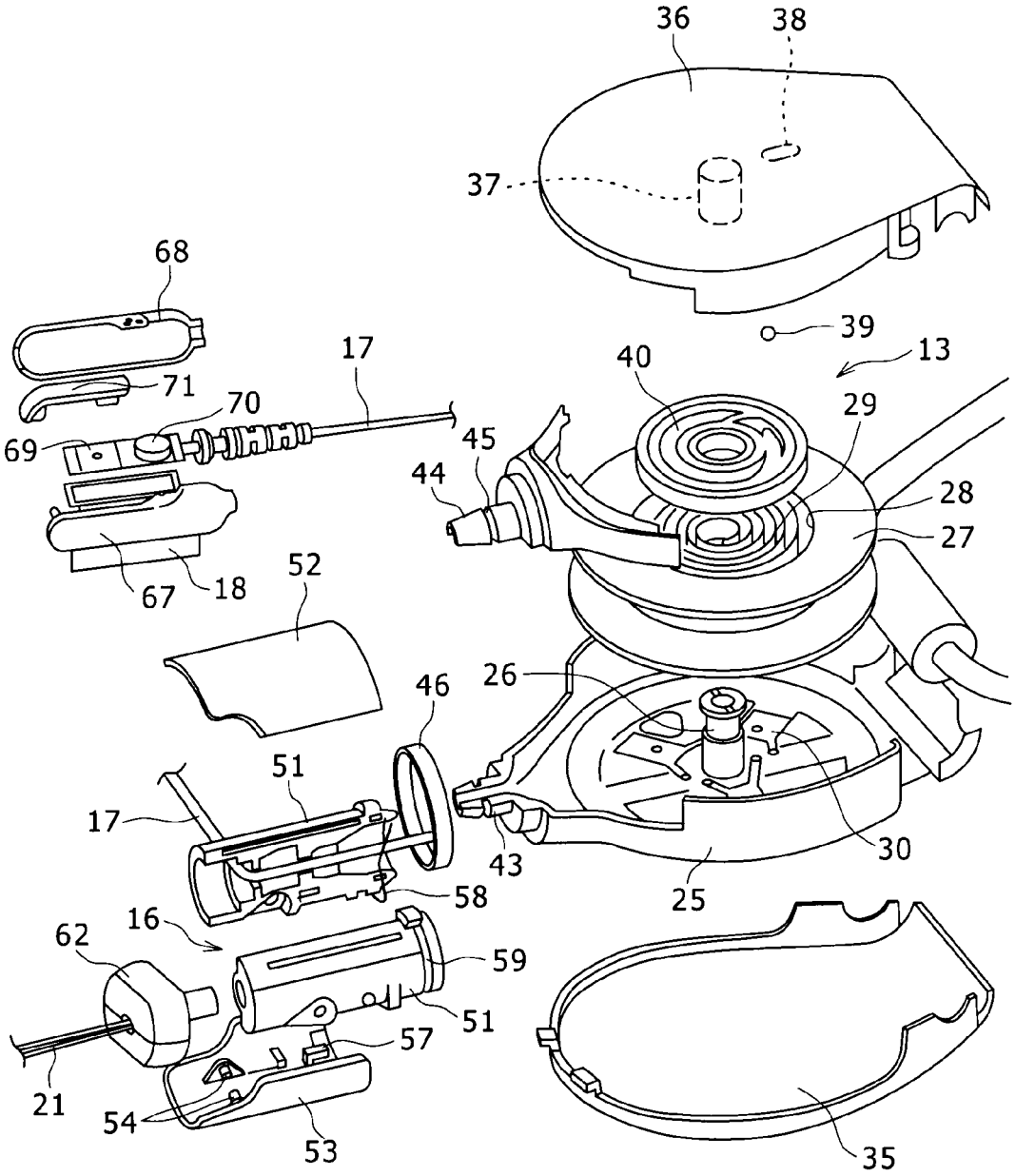
FIG. 3 is an exploded perspective view illustrating a configuration of a reeling device.

FIG. 3 illustrates a configuration of the reeling device 13 and the connecting member 16. The reeling device 13 includes a chassis 25 and a spindle 26 which is located at the central portion of the chassis 25 so as to extend upright. A reel 27 is turnably supported by the spindle 26 to reel the cord 17. The reel 27 is formed at an upper portion with a recess portion 28 adapted to receive a flat spiral spring 29 therein. The flat spiral spring 29 is charged with an elastic restoring force adapted to reel the cord 17 around the outer circumferential surface of the reel 27. The reel 27 is provided with a slip ring on the lower surface and a brush 30 is attached to the bottom of the chassis 25 so as to come into contact with the slip ring. The brush 30 is connected to the cord 11 arranged to extend along the neck strap 10. In this way, the cord 17 capable of being reeled around the reel 27 and the cord 11 arranged to extend along the neck trap 10 are electrically connected with each other through the slip ring and through the brush 30.

A front cover 35 is attached to the lower surface of the chassis 25. A rear cover 36 is attached to the chassis 25 from the upper side. The rear cover 36 is provided with a support shaft 37 extending upright from the lower surface thereof. A holder 38 is disposed on the side of the support shaft 37 to support a ball 39. The ball 39 is a steel ball, which is fitted into a groove of a lock disk 40. In addition, the lock disk 40 is joined to the reel 27. In this way, the cord 17 is unreeled and locked via this lock disk 40.

Figure 5:
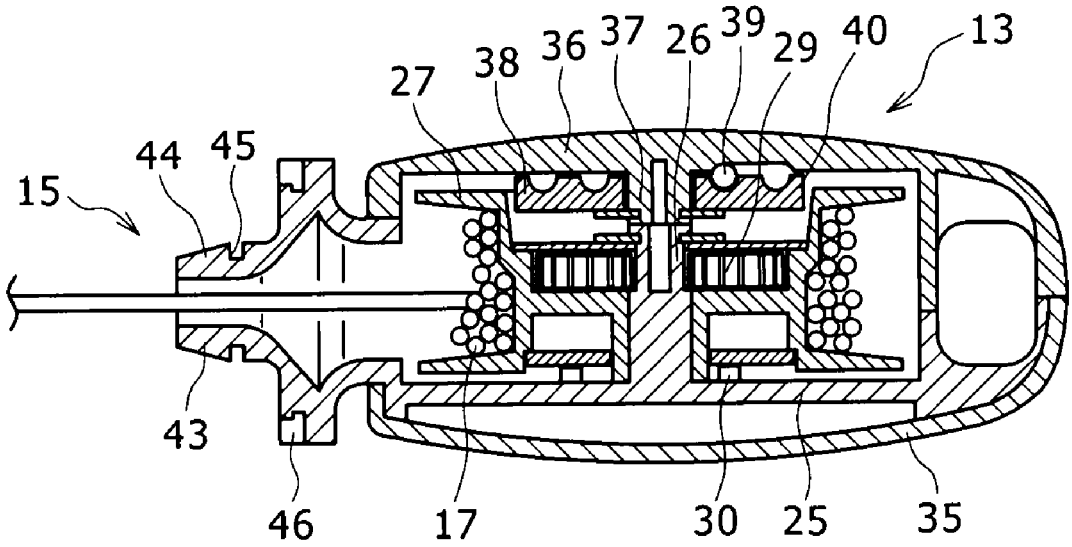
FIG. 5 is a longitudinal cross-sectional view illustrating the internal structure of the reeling device.

The reeling device is closed by the front cover 35 and by the rear cover 36 to be formed with the tubular orifice portion 15 at the lower end side thereof. The tubular orifice portion 15 is composed of a semi-tubular portion 43 extending from the chassis 25 and a semi-tubular portion 44 pressed by the rear cover 36. The semi-tubular portions 43, 44 are joined together to form the tubular orifice portion 15. The tubular orifice portion 15 is formed with an engaging groove 45 on the outer circumferential surface. This engaging groove 45 achieves the engagement of the connecting member 16 with the reeling device 13. A press ring 46 is attached to the root side of the tubular orifice portion 15 to hold the semi-tubular portions 43, 44 constituting the tubular orifice portion 15 in a joined manner. FIG. 5 illustrates a cross-sectional configuration of the reeling device 13 configured as described above.

Figure 6:
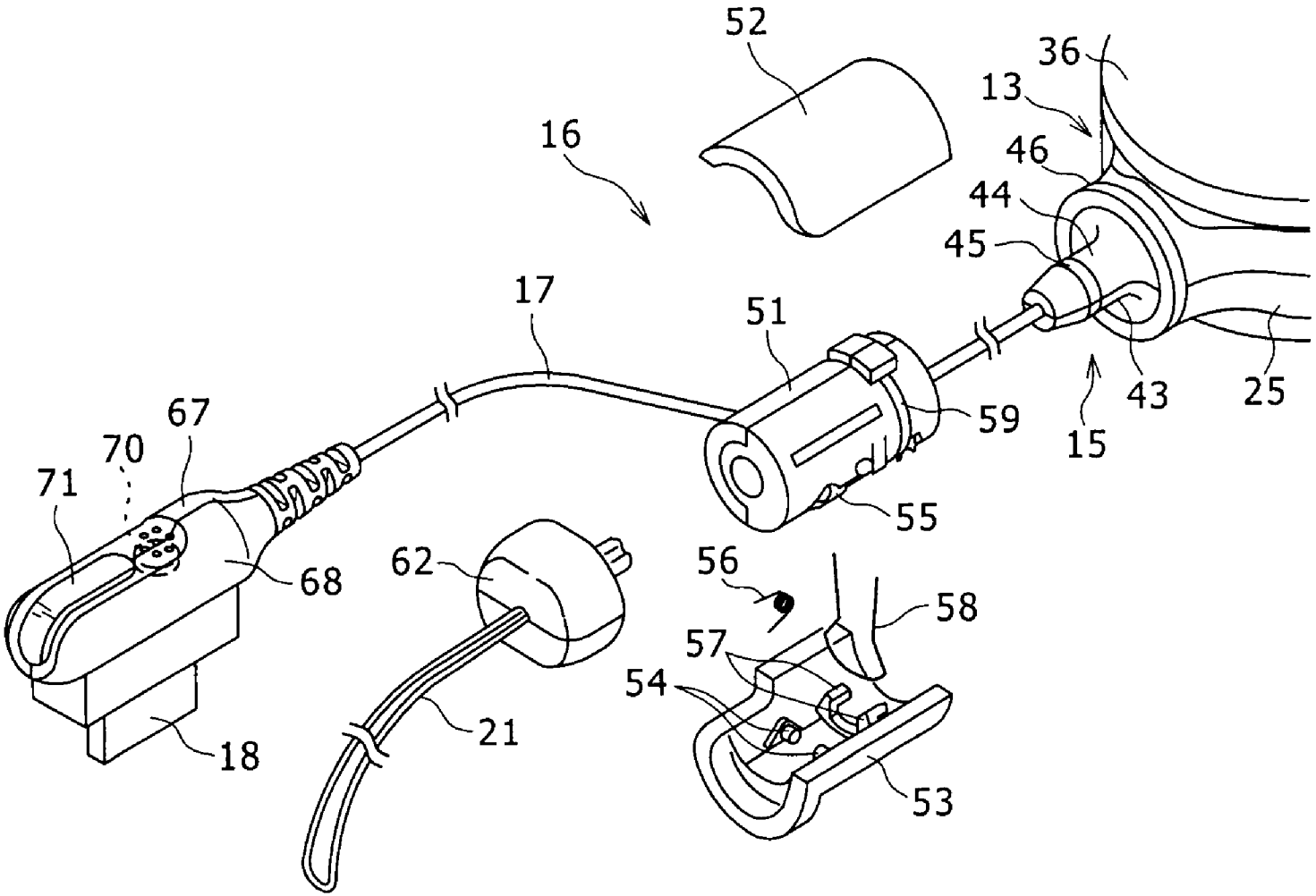
FIG. 6 is an exploded perspective view illustrating the configuration of a connecting member connected to a tubular orifice portion of the reeling device.
Figure 7A:
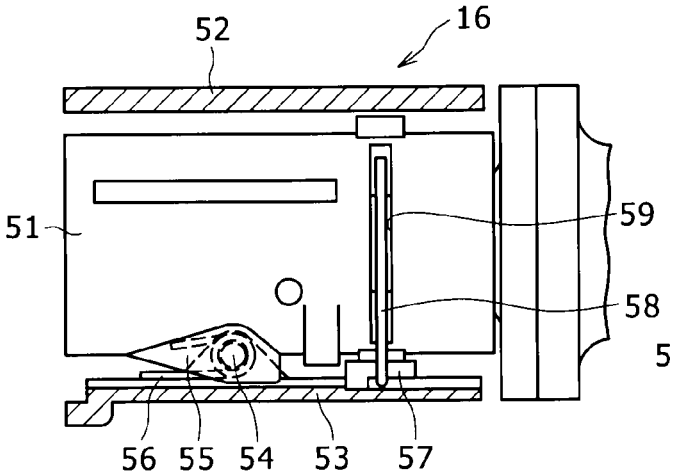
FIGS. 7A and 7B are longitudinal and transverse cross-sectional views, respectively, illustrating the engaging action of the connecting member.

A description is next given of a configuration of the connecting member 16 connected to be engageable with and disengageable from the tubular orifice portion 15 of the reeling device 13. As shown in FIGS. 3 and 6, the connecting member 16 is provided with a tubular cord holder 51. The cord 17 is inserted into the cord holder 51 and pulled out therefrom laterally. The cord holder 51 is attached with a rear side check 52 at the upper portion and with an operating member 53 at the lower end side. Projecting support shafts 54 are provided on the inner side of the operating member 53 so as to be opposed to each other. The support shafts 54 are turnably supported by corresponding bearings 55 provided on the lower surface of the cord holder 51. In short, the operating member 53 is turnably supported via the support shafts 54 and by the bearings 55 on the lower surface of the cord holder 51. In addition, a coil spring 56 is attached around each of the support shafts 54. As shown in FIG. 7A, the operating member 53 is biased by the coil springs 56 to turn around the support shafts 54 counterclockwise.

A pair of hooks 57 is integrally formed on the inner surface of the operating member 53 so as to support a clip spring 58. The clip spring 58 is formed in an almost-U shape and received in slits 59 formed on both sides of the cord holder 51. The clip spring 58 is engaged with the engaging groove 45 in the outer circumferential surface of the tubular orifice portion 15 to bring the connecting member 16 into engagement with the tubular orifice portion 15 of the reeling device 13. Thus, the load of the mobile-phone 20 is received by the reeling device 13 via the connecting member 16 and via the tubular orifice portion 15, that is, is not applied to the cord 17.

An attachment member 62 is attached to an end of the cord holder 51. The hanging strap 21 is attached to the attachment member 62 and inserted into a string insertion hole of the mobile-phone. Thus, the connecting member 16 hangs and holds the mobile-phone 20 via the hanging strap 21 attached to the attachment member 62.

A structure of the plug 18 is next described. The plug 18 is connected to the tip of the cord 17 pulled out from the side of the cord holder 51. As shown in FIGS. 3 and 6, the plug 18 includes plug cases 67, 68 joined together from both sides and a circuit board 69 in the plug cases 67, 68. A microphone 70 is mounted on the circuit board 69 and an operation button 71 is attached to the plug cases 67, 68 from above.

Figure 4A:
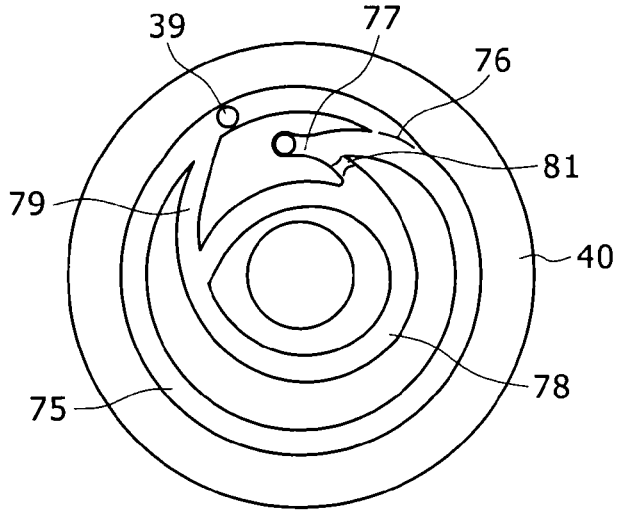
FIGS. 4A, 4B and 4C are front view illustrating actions of a lock mechanism of the reeling device.
Figure 4B:
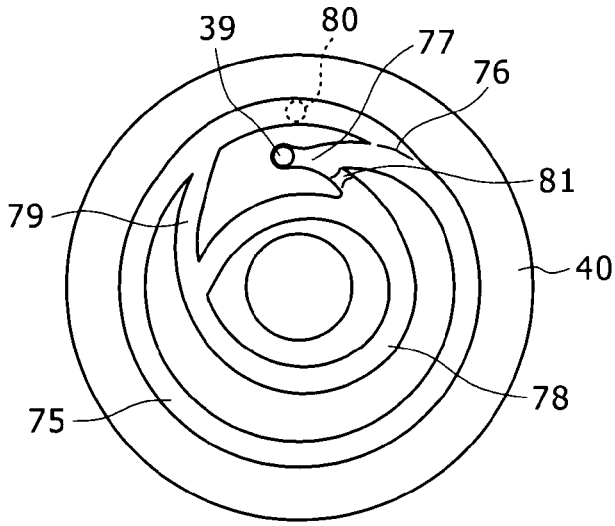
Figure 4C:
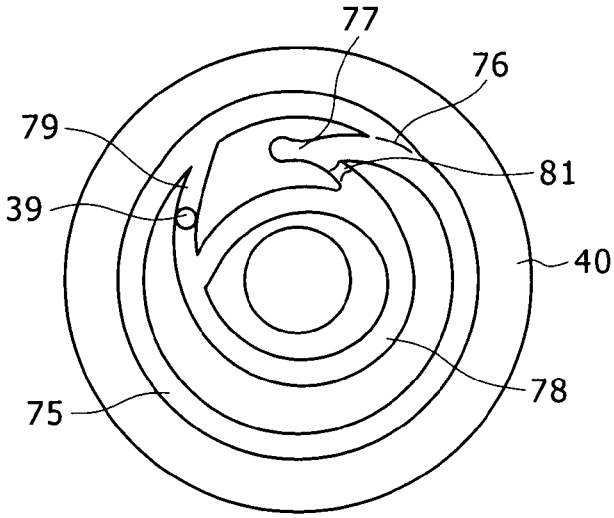

A description is next given of how the reeling device 13 operatively reels the cord 17. Referring to FIGS. 4A, 4B and 4C, the lock disk 40 is formed with an outer circumferential groove 75 on the outer circumferential side thereof. The outer circumferential groove 75 is formed with a wall portion 76 at a predetermined internal circumferential position. The wall portion 76 has a relatively low height. A V-shaped lock portion 77 is formed near the wall portion 76. In addition, the lock disk 40 is formed with an inner circumferential groove 78 on the central side thereof. A communication groove 79 is formed to bring the inner circumferential groove 78 into communication with the outer circumferential groove 75.

Such a mechanism portion which uses the lock plate 40 to reel the cord 17 operates such that the reel 27 is slightly returned and stopped when the cord 17 is pulled out, and reeling is started when the cord 17 is slightly pulled to reel it. This operation is explained with reference to FIGS. 4A, 4B and 4C. Incidentally, this reeling device is such that the reeling disk 40 is connected to the reel 27 and the ball 39 can radially be moved by the holder 38. For the convenience of explanation, the explanation is given with the ball 39 turnably operated with respect to the lock disk 40 in view of the fact that the ball 39 is turned with respect to the lock disk 40.

When the cord 17 is pulled out, the ball 39 moves clockwise in the outer circumferential groove 75 of the lock disk 40 shown in FIG. 4A. While the cord 17 is pulled out, the ball 39 repeatedly gets over the wall portion 76 which blocks the outer circumferential groove 75. This makes it possible to unreel even the full length of the cord 17 reeled around the reel 27.

As shown in FIG. 4B, when the cord 17 is stopped to be unreeled, the reel 27 is turned counterclockwise by the elastic restoring force of the flat spiral spring 29 to reel the cord 17 around it. At this time, the ball 39 moves clockwise in the outer circumferential groove 75 of the lock disk 40 and is caught by the V-shaped lock portion 77 continuous with the inner circumferential groove 78, thus leading to the locking operation in the state shown in FIG. 4B. In such a state, the relative movement between the ball 39 and the lock disk 40 is stopped to lock the reel 27. When the ball 39 is located at the maximum reeled position 80 in FIG. 4B, it is returned counterclockwise to the lock position through the longest course, whereby the cord 17 of up to about 80 mm is pulled in and stopped.

If the cord 17 is further pulled with the ball 39 locked by the V-shaped lock portion 77 as described above, the ball 39 is moved clockwise in the inner circumferential groove 78 from the V-shaped lock portion 77. If the ball 39 is turned counterclockwise, it may not get over the wall portion 81 which separates the V-shaped lock portion 77 from the inner circumferential groove 78. However, if the ball 39 is turned clockwise, it can get over the wall portion 81. Thereafter, the ball 39 which passed the inner circumferential groove 78 is moved in the outer circumferential groove 75 through the communication groove 79. Thus, the ball 39 operates in the same manner as shown in FIG. 4A. Incidentally, if the cord 17 is returned while the ball 39 is in the inner circumferential groove 78, the ball 39 continues to turn counterclockwise in the inner circumferential groove 78. Thus, since the locking operation is not done, the cord 17 of the full-length is rereeled. The cord 17 has an unreeled length of 0.5 m and a maximum lockable length of 0.45 m.

The flat spiral spring 29 disposed under the lock disk 40 uses a leaf spring with a thickness of about 0.1 mm. This flat spring 29 may not bear a force demanded to hang a mobile-phone that has a one-segment function and a settlement function and that weighs about 160 g. Therefore, if the user lets go the mobile-phone with the lock by the lock disk 40 released, the mobile-phone 20 drops with the cord 17 pulled out from the reel 27 of the reeling device 13. However, since the operation of the reel 27 eases the drop of the mobile-phone 20, it is prevented from making large impact on the mobile-phone 20.

It is desired only to pull the cord 17 for reeling, which eliminates a reeling button. This can prevent inadvertent reeling at the time of wearing the strap.

Figure 7B:
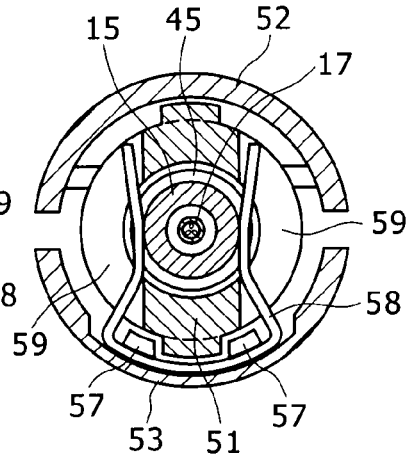

A structure of engaging and disengaging the connecting member 16 with and from the tubular orifice portion 15 is described with reference to FIGS. 7A and 7B. If the connecting member 16 is connected to the tubular orifice portion 15 of the reeling device 13, the tubular orifice portion 15 enters the central hole of the cord holder 51. This causes the clip spring 58 facing the slit 59 of the cord holder 51 to get over the leading end side taper portion of the tubular orifice portion 15 and fall into the engaging groove 45. In other words, the clip spring 58 achieves the structure of engaging the tubular orifice portion 15 with the connecting member 16. Thus, the engaging structure of the clip spring 58 brings the mobile-phone 20 hung by the connecting member 16 via the hanging strap 21 into the state where the load is borne by the casing of the reeling device 13.

Figure 8A:
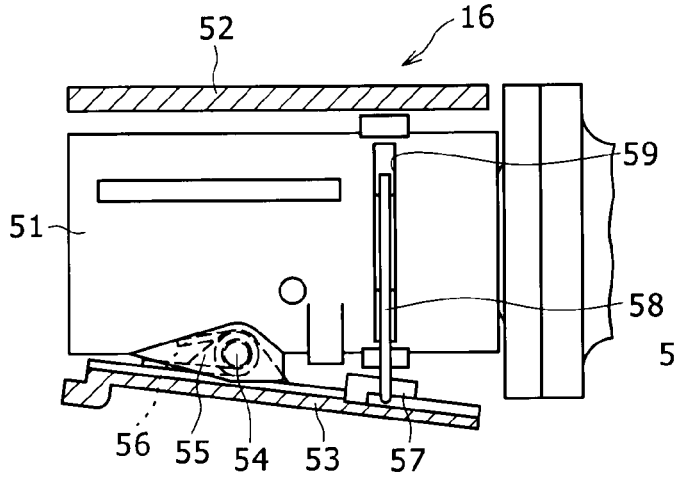
FIGS. 8A and 8B are longitudinal and transverse cross-sectional views, respectively, illustrating the releasing action for the engagement.
Figure 8B:
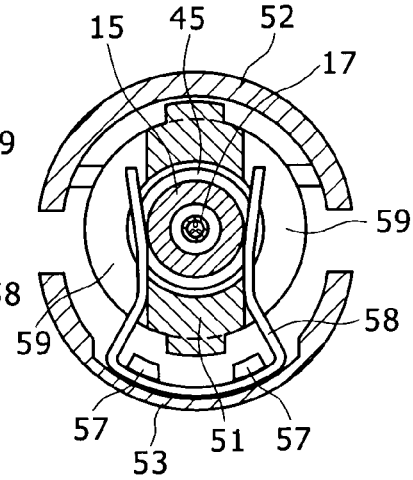

Next, the operating member 53 of the connecting member 16 is pressed as shown in FIG. 8A and operatively turned clockwise around the support shafts 54 against the biasing force of the coil springs 56. This causes the hooks 57 on the rear side of the operating member 53 to pull the clip spring 58 downward. Thus, the clip spring 58 received inside the slit 59 is disengaged from the engaging groove 45 of the tubular orifice portion 15. In addition, the engagement of the connecting member 16 with the tubular orifice portion 15 of the reeling device 13 is released.

In this way, when television broadcasting is watched on the mobile-phone 20 using e.g. a one-segment function or the mobile-phone 20 is caused to access the touch sensor of the automatic ticket gate, the mobile-phone 20 can be located at lower positions as shown in FIG. 2. In this case, the cord 17 having the plug 18 connected to the mobile-phone 20 is pulled out from the tubular orifice portion 15 of the reeling device 13. In other words, when the user passes through an automatic ticket gate using the mobile-phone 20, the connecting member 16 can be removed from the tubular orifice portion 15 by operating the operating member 53 of the connecting member 16 attached with the hanging strap 21 while holding the mobile-phone 20 with the user's hand.

Figure 9A:
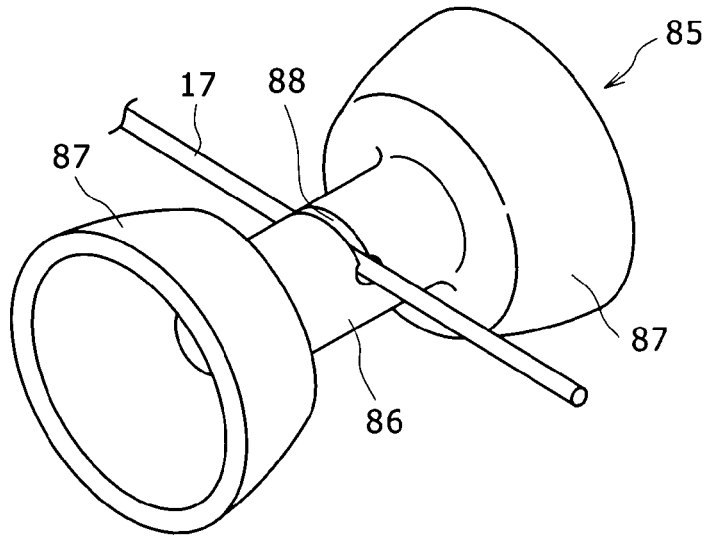
FIGS. 9A, 9B and 9C are perspective views illustrating the cord-reeling action of a reeling device.
Figure 9B:
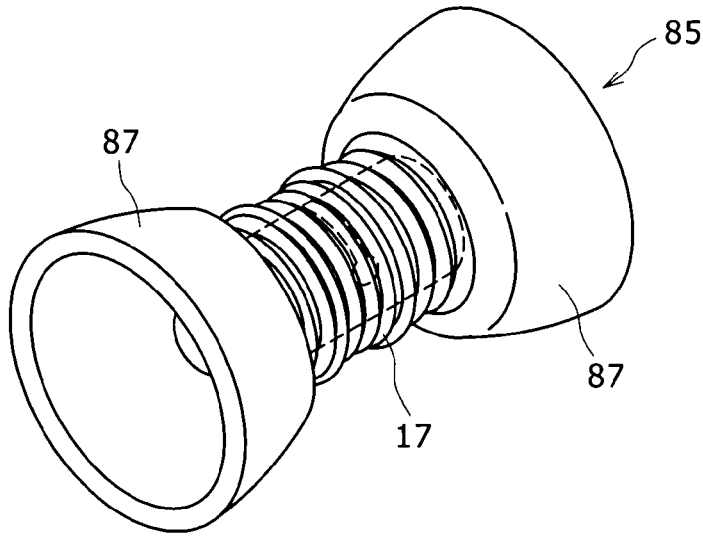
Figure 9C:
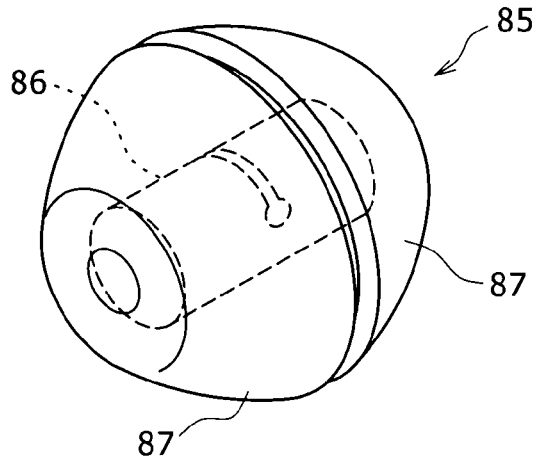
Figure 10:
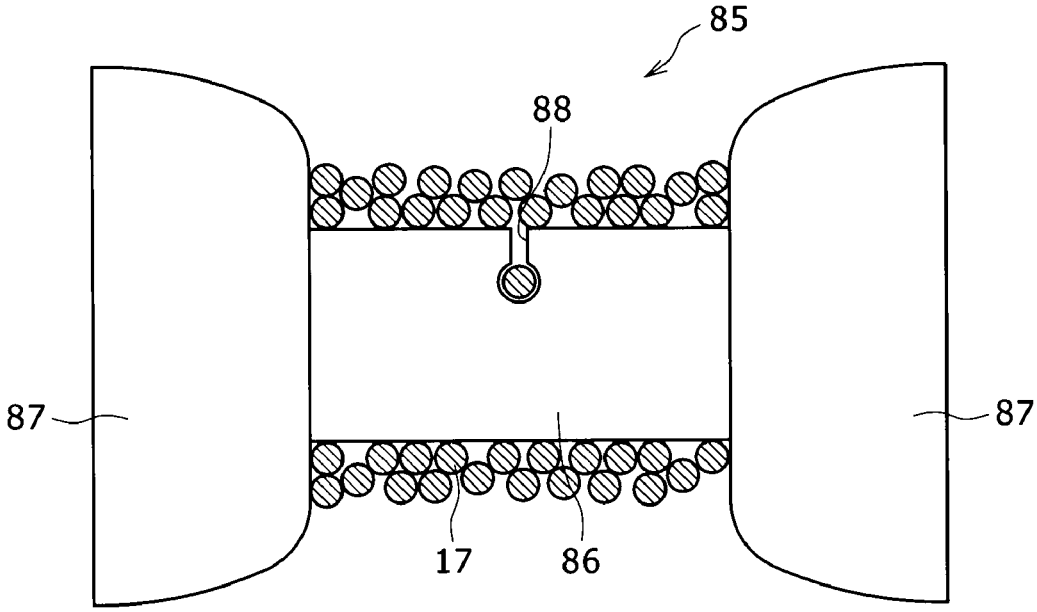
FIG. 10 is a front view illustrating the cord-reeling action of the reeling device.
Figure 11:
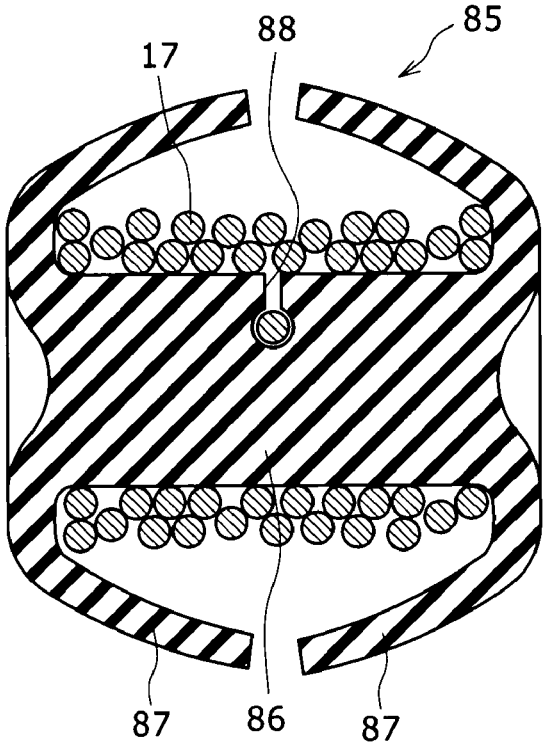
FIG. 11 is a longitudinal cross-sectional view of the reeling device with flanges elastically deformed to be close to each other.

A description is next given of a reeler 85 or a second reeling device for the cord 17 (see FIG. 1) which is pulled out from the side of the connecting member 16 and to which the plug 18 is connected at the leading end thereof. Referring to FIGS. 9 to 11, this reeler 85 is an integrally molded body made of an elastic material, e.g. rubber as shown in FIGS. 9 to 11 and includes a reeling portion 86 formed like a bar at the intermediate portion thereof. Incidentally, the reeling portion 86 is not necessarily a solid bar but may be formed as a tubular body. Cuplike or semispherical flanges 87 are integrally joined to both respective sides of the reeling portion 86. The flanges 87 assume two postures: one is that both the flanges 87 are opposite with each other as shown in FIGS. 9A and 9B and the other is that their outer circumferential edges are brought into contact with or close to each other as shown in FIG. 9C. Specifically, the flanges 87 are elastically deformed to assume any of the postures, namely, to take any of separate positions and close positions, with a certain position centered therebetween. In addition, the reeling portion 86 is formed at an intermediate position with a retaining portion 88 formed as a recessed portion as shown in FIG. 10. The cord 17 to be reeled is partially inserted into the retaining portion 88 and is retained thereat.

If the cord 17 is reeled by the reeler 85 integrally molded of rubber as described above, it is retained at the retaining portion 88 of the reeling portion 86 as shown in FIGS. 9A and 10. In such a state, the cord 17 is reeled around the outer circumferential portion of the reeling portion 86 as shown in FIGS. 9B and 10. Incidentally, the amount of reeling corresponds to the excess length of the reeled cord longer than the necessary length of the cord 17 as shown in FIG. 1.

To reel the cord 17 by the reeling portion 86, as shown in FIGS. 9A, 9B and 10, the flanges 87 formed cuplike on both sides of the reeling portion 86 are preliminarily elastically deformed to be opposite with each other. This makes it easy to reel the cord 17 around the reeling portion 86. After the cord 17 is reeled, the flanges 87 on both the sides are elastically deformed to be close to each other as shown in FIGS. 9C and 11. By elastically deforming the flanges 87 beyond the predetermined position, the deforming action of the flanges 87 causes the posture in which the outer circumferential edges of the flange 87 come close to or are brought into abutment against each other. Changing the flanges 87 into such a posture forms the entire reeler 85 into a substantial sphere as shown in FIG. 9C so that the cord 17 reeled around the reeling portion 17 may not virtually be viewed from the outside. In addition, since the inner reeling portion is covered by the flanges 87, the cord 17 will not loose unexpectedly.

Figure 12:
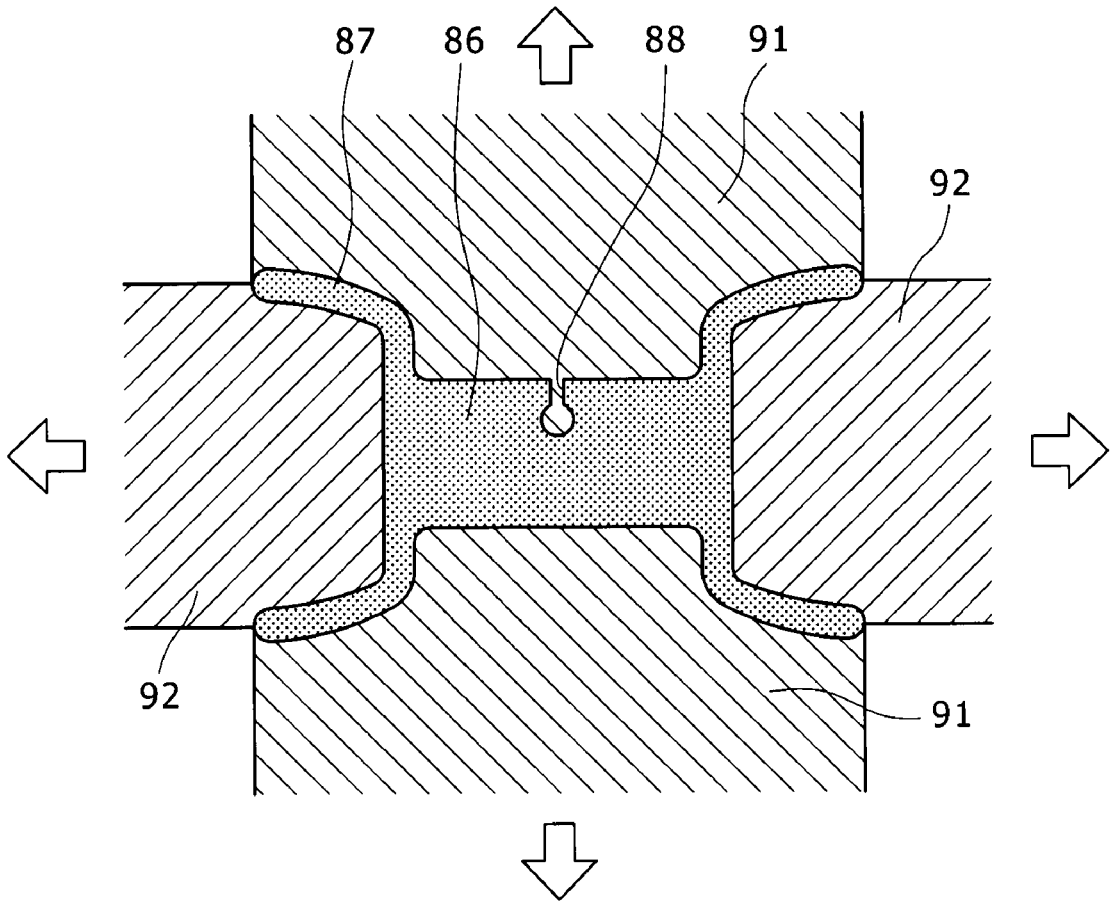
FIG. 12 is a longitudinal cross-sectional view of molding dies for molding the reeling device.

Molding equipment for molding such a reeler 85 is shown in FIG. 12. The molding equipment includes a pair of first molding dies 91 closable and openable in a vertical direction perpendicular to the axial direction of the reeling portion 86; and a pair of molding dies 92 closable and openable in the axial direction of the reeling portion 86. The molding dies 91, 92 are closed with one another to define a cavity therebetween. Molten rubber is injected and molded to provide an integrally molded reeler 85. Since such a reeler 85 is a rubber injection molded body as described earlier, it is one piece and the flanges 87 are structured to be elastically deformable. In addition, the reeler 85 is manufactured as a single component part.

In this embodiment, the strap device type headphone/headset is operative to cause the reel 27 incorporating the flat spiral spring 29 to reel the cord 17 connected to the mobile-phone 20. In this headphone/headset, even if the mobile-phone 20 is heavy, it will not move downward under its own weight because of using the connecting member 16 having the clip spring 58. Further, also when pulled out, the cord 17 can lightly be pulled out against the weak elastic restoring force of the flat spiral spring 29. In addition, the reeling force of the reel 27 resulting from the flat spiral spring 29 is not too strong. Since the mobile-phone 20 is connected to the cord 17 via the plug 18, the length of the cord 17 can be adjusted. In this way, when watching television broadcasting on the mobile-phone by use of the one-segment function, the user can watch it while dangling the mobile-phone 20 from the neck via the neck strap 10. In addition, also when causing the mobile-phone 20 to access the touch sensor of an automatic ticket gate, the user can easily hold the mobile-phone 20 over the touch sensor as shown in FIG. 2. In this case, the user does not need to remove the neck strap 10 from the neck each time. If the mobile-phone is used as a head set, a microphone 70 is disposed inside the plug 18 so that the shield line of the microphone 70 can be terminated inside the microphone and the cord 17 reeled by the reeling device is used for only an audio signal. This can make the wire configuration simple and also the cord 17 thin, which can enable the downsizing and weight reduction of the reeling portion and an improvement in durability due to the prevention of cord disconnection. The excess portion of the cord 17 with the connection plug is reeled around the reeler 85 (see FIG. 1) or is composed of a curl cord. Thus, the excess portion of the cord 17 will not run over.

More specifically, a portion of the cord 17 that is pulled out from the side of the connecting member 16 and that is the excess portion of the cord 17 whose leading end is connected to the plug 18 is reeled by the reeler 85. The reeler 85 is made of integrally molded rubber as described above. As shown in FIGS. 9A and 9B, the reeling device described above is such that the flanges 87 on both the sides of the reeling portion 86 are made to separate from each other. In this state, the cord 17 is reeled around the reeling portion 86. In addition, after the cord 17 is reeled by a predetermined length, the flanges 87 on both sides are elastically deformed to bring their outer circumferential edges into abutment against or close to each other as shown in FIG. 9C. Thus, the excess portion of the cord 17 is reeled in the almost-spherical reeling device, whereby it can easily be handled.

The present invention has been described according to the illustrated embodiment thus far but it is not limited thereto. The invention can be modified or altered in various ways within the scope of the technical concept of the invention. For example, the engaging structure of the connecting member 16 with the tubular orifice portion 15 of the reeling device 13 does not necessarily need to use the clip spring 58 and various other engaging structures may optionally be selected. In addition, the hanging device described above is not necessarily limited to that of the mobile-phone 20 and can widely be used for various other portable electronic devices.

The present invention can widely be used for a hanging device hanging a mobile-phone through a neck strap.

It should be understood by those skilled in the art that various modifications, combinations, sub-combinations and alterations may occur depending on design requirements and other factor in so far as they are within the scope of the appended claims or the equivalents thereof.

What is claimed is:

1. A hanging device, comprising:

a reeling portion which includes a reel adapted to reel a cord, the reel is turned to pull out the cord from an orifice portion and to reel the cord through the orifice portion by means of a spiral spring connected to the reeling portion;

an engaging portion including a circumferential groove disposed around the orifice portion of the reeling portion; and a connecting member attached to the cord, the connecting member including:

a lower piece having a hook disposed thereon, and a movable clip that is configured to engage the circumferential groove, so as to be engageable with and disengageable from the engaging portion of the orifice portion, a bottom portion of the movable clip being hooked by the hook on the lower piece of the connecting member, such that a force applied to the lower piece of the connecting member disengages the movable clip from the circumferential groove.

2. The hanging device according to claim 1, wherein the cord has a plug located at a tip thereof and is connectable to an electronic device via the plug.

3. The hanging device according to claim 1, further comprising a hanging strap attached to the connecting member.

4. The hanging device according to claim 1, wherein the reeling portion is such that a pulling length of the cord is in a range from 0 to 0.6 m.

5. The hanging device according to claim 1, wherein the reel has a locking portion, the cord may not be reeled when the reel is locked by the locking portion and the locking by the locking portion can be released when the cord is pulled out in the locking state.

6. The hanging device according to claim 2, wherein the plug internally includes a microphone.

7. The hanging device according to claim 2, wherein the plug is provided with an operating button.

8. The hanging device according to claim 2, further comprising a second reeling portion connected to the cord and located at a predetermined position between the plug and the reeling portion;

wherein the second reeling portion is adapted to reel an excess portion of the cord.

9. The hanging device according to claim 1, wherein the movable clip is a substantially U-shaped clip spring having two vertically extending arms, the clip spring being disposed such that the arms clasp into the circumferential groove on opposing sides of the groove.

10. The hanging device according to claim 9, wherein the cord is attached through the center of the connecting member passing between the arms of the clip spring and exits the connecting member to a connected device through a side wall of the connecting member.

11. The hanging device according to claim 1, wherein the lower piece is pivotally attached to the connecting member, and the force applied to disengage the connecting member from the reeling portion is applied to a first end of the lower piece opposite of a second end of the lower piece having the hook disposed thereon.

12. The hanging device according to claim 1, wherein the lower piece of the connecting member is elastically held in tension by a coil spring, such that the lower piece returns to a normal position after the force is applied to disengage the movable clip from the circumferential groove.

13. The hanging device according to claim 1, wherein the connecting member further includes an attachment member that secures a connected device proximate to the cord such that a load of the connected device is borne by the reeling portion.

14. The hanging device according to claim 8, wherein the second reeling portion includes elastic flanges which are forced inward to secure the excess portion of the cord.

15. The hanging device according to claim 1, wherein the engaging portion is configured to be inserted into the connecting member.

16. The hanging device according claim 1, wherein the movable clip is substantially concealed in the connecting member by the lower piece and an upper piece of the connecting member.

* * * * *